United States Patent [19]

Murakami

[11] 4,172,372

[45] Oct. 30, 1979

[54] METHOD OF KNITTING FABRIC BY STICK-LIKE DOUBLE-HOOKED NEEDLE

[76] Inventor: Fusako Murakami, No. 38-4, 1-chome, Kakigara-cho, Nihonbashi, Chuo-ku, Tokyo, Japan

[21] Appl. No.: 818,250

[22] Filed: Jul. 22, 1977

Related U.S. Application Data

[63] Continuation-in-part of Ser. No. 644,938, Dec. 29, 1975, abandoned.

[51] Int. Cl.[2] ..... D04B 1/00

[52] U.S. Cl. ..... 66/195

[58] Field of Search ..... 66/198, 118, 117, 195

[56] References Cited

U.S. PATENT DOCUMENTS

| | | | |
|---|---|---|---|
| 1,269,014 | 6/1918 | Stansbery | 66/118 |
| 1,289,470 | 12/1918 | Jensen | 66/118 |
| 1,502,584 | 7/1924 | Perry | 66/118 X |
| 2,093,631 | 9/1937 | Burnham | 66/118 X |
| 2,465,636 | 3/1949 | Doerr | 66/118 |
| 3,229,484 | 1/1966 | Standant | 66/118 |
| 3,438,224 | 4/1969 | Ingersoll | 66/117 |
| 3,886,768 | 6/1975 | Anderson | 66/198 |

FOREIGN PATENT DOCUMENTS

| | | | |
|---|---|---|---|
| 771675 | 6/1934 | France | 66/118 |
| 47-39965 | 12/1972 | Japan | 66/118 |
| 50-46054 | 12/1975 | Japan | 66/118 |
| 5507 | of 1911 | United Kingdom | 66/118 |
| 196832 | 5/1923 | United Kingdom | 66/118 |
| 434641 | 9/1935 | United Kingdom | 66/118 |

*Primary Examiner*—W. H. Schroeder
*Assistant Examiner*—A. Falik
*Attorney, Agent, or Firm*—Stevens, Davis, Miller & Mosher

[57] ABSTRACT

Fabric is knitted by a stick-like double-hooked needle. The stick-like double-hooked needle which knit reversible Afghan stitches comprises a stick-like stem having the same diameter throughout the length thereof and hooks formed on both the ends of the stem and having a size substantially equal to the diameter of the stem. Each hook is a sharpened top end and both the hooks have the same configuration.

1 Claim, 16 Drawing Figures

METHOD OF KNITTING FABRIC BY STICK-LIKE DOUBLE-HOOKED NEEDLE

CROSS REFERENCES TO RELATED APPLICATION

The present application is a continuation in part application of U.S. Pat. Application No. 644,938 filed on Dec. 29, 1975 now abandoned.

BACKGROUND OF THE INVENTION (1) Field of the Invention

This invention relates to a method of knitting fabric by a stick-like double-hooked needle. More particularly, the invention relates to a method of knitting fabric by a stick-like double-hooked needle for forming knitted fabrics by knitting forwardly with one hook and knitting back with the other hook.

(2) Description of the Prior Art

When a conventional single hooked needle is used in, for example, knitting the so-called Afghan stitch, the stitches are engaged with the stem of the needle and the fabric is formed by taking these stitches off the stem. In this case, one face of the knitted fabric has a knit structure and the other face has a purl structure. Accordingly, when the fabric is turned back to form a collar or lapel, the pattern differs at the collar or lapel portion, and hence, it is difficult by the use of such conventional needle to form a knitted fabric which can be worn on either the front face or the back face. Further, in the case of the Afghan stitch, the length of the knitted fabric is limited by the length of the needle stem and a fabric of a long length cannot be knitted. Further, a ring can be formed only by linking the ends of a length of knitted fabric. Moreover, in conventional hooked needles having a hook on one end or hooks on both ends, the stem portion is formed to have a larger diameter than the hook portion so as to facilitate the knitting operation. Accordingly, stitches formed on the hook portion cannot easily pass over the stem portion and if they are passed over the stem portion, the wool is forcibly pulled on passage and a good knitted fabric cannot be obtained. Further, in this case, the operation speed cannot be heightened and the operation involves difficulties, and knitting is impossible with yarns having no stretchability, such as lace yarns.

Further, there are but several methods for knitting fabric with reversible Afghan stitches, so that new knitting methods are desired by people who enjoy knitting.

It is therefore a primary object of the present invention to provide a stick-like double-hooked needle capable of providing knitted fabrics having the same pattern or a plurality of patterns on both the front and back faces or having different colors in the front and back faces, by the use of which needle the knitting operation can be performed at a high speed very simply and easily.

Generally in using conventional single hooked needles, the knitting is first conducted forwardly and then back knitting is conducted in the opposite direction. On the other hand, in using the hooked needle of the present invention, since hooks are formed on both ends, back knitting can be conducted in the same diretion only by turning the fabric over and both knit and purl stitches can be formed on both the faces. Accordingly, a variety of knitted fabrics differing in texture and appearance can be obtained by changing the combination of knit and purl stitches. Turned back portions such as the collars of shawls, sweaters and jackets need not be overlayed with another material since the same pattern can be formed on both faces. Therefore, the hooked needle of the present invention can be applied to various arrangements which are not attainable by conventional single hooked needles.

It is a further object of the invention to provide new methods of knitting fabric with reversible Afghan stitches.

SUMMARY OF THE INVENTION

In accordance with the present invention, there is provided a stick-like double-hooked needle comprising a stem having the same diameter throughout its length and hooks formed on both the ends of said stem, said hooks having a size substantially equal to the diameter of the stem, both the hooks having the same configuration. The stem of the hooked needle of the present invention has a length longer than that of the conventional single hooked needle. In general, a double-hooked needle having a stem length of about 40 cm is easiest to use.

When a fabric having the same front and back faces is formed by using the above double-hooked needle of the present invention, a row of chain stitches of a desired length (not limited by the length of the hook needle) is formed by the hook on one end of the stem, and stitches are picked up by the same hook as forward knitting is first conducted in the direction opposite to the direction in which the chain stitches was knitted. The stitches are fitted on the stem, and when the stem portion is substantially filled with these stitches, another yarn is supplied to the other hook and first back knitting is conducted in the same direction as that of the first forward knitting while taking stitches fitted on the stem off the stem, whereby the first knitting is formed.

When the first back knitting has been conducted up to the end of the fabric, second forward knitting is conducted in the direction opposite to the first forward knitting with the yarn of the first forward knitting by using the hook on the other end, and second back knitting is conducted with the yarn of the first back knitting. By repeating forward knitting and back knitting in this manner, a basic knitted fabric having the same front and back faces can be obtained.

When the chain stitch is longer than the stem of the hooked needle, namely when it is desired to form a long fabric, first forward knitting and first back knitting are continued by using both the hooks alternately until the prescribed length is obtained. In this manner, a knitted fabric having an indefinitely long length can be formed. When it is desired to form a ring-like knitted article, beginning and terminal ends of the forward knitting of a portion to be formed into a ring are connected, and in this manner, a fabric formed by subsequent knitting comes to have a ring-like shape.

As illustrated above, when the hooked needle of the present invention is used, a knitted fabric having the same configuration on both the front and back faces and capable of being used on both the faces similarly conveniently can be prepared. Further, a long fabric and a ring-like fabric can also be prepared by using a relatively short needle (about 40 cm as pointed out hereinbefore) according to the present invention. As is seen from the foregoing illustration, when the hooked needle of the present invention is used, stitches pass over the stem portion during the above-mentioned forward knitting and back knitting. Accordingly, it is necessary that the size of each hook should be adjusted so that the stitches can pass over the stem portion smoothly, even if the stitches are formed by ordinary knitting.

When the hooked needle of the present invention is employed, as is seen from the foregoing illustration, a variety of knitted fabrics having different patterns can be formed by using different color yarns in the above-mentioned forward knitting and back knitting, connecting yarns with other yarns or by changing yarns alternately in the forward knitting and back knitting, for example, by conducting the second forward knitting with the yarn of the first back knitting after completion of the first back knitting.

In case both the faces of a knitted fabric are thus formed by forward knitting and back knitting, if the fabric is turned back at the collar portion, for example, since the pattern is the same on both faces, no strange impression is given.

BRIEF DESCRIPTION OF THE DRAWINGS

The present invention will be more apparent upon referring to the accompanying drawings which are illustrative of the invention.

DETAILED DESCRIPTION OF THE PREFERRED EMBODIMENT

Figure 1:
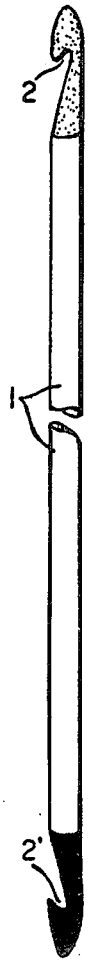
FIG. 1 is a partially cut-out front view of the stick-like double-hooked needle of the present invention.

The stick-like double-hooked needle of the present invention will now be described with reference to FIG. 1. The hooked needle of the present invention comprises a stem 1 composed of bamboo, metal, synthetic resin or the like and having the same diameter throughout its length and a relatively long length (about 40 cm), and a leading hook 2 and trailing hook 2′ colored in different hues of the same configuration formed on opposite ends of the stem 1 and having a size substantially equal to the diameter of the stem 1, each hook having a sharpened top end.

As an example, formation of a knitted fabric having the same pattern on the front and back faces by the use of the stick-like double-hooked needle of the present invention will now be described.

Figure 2:
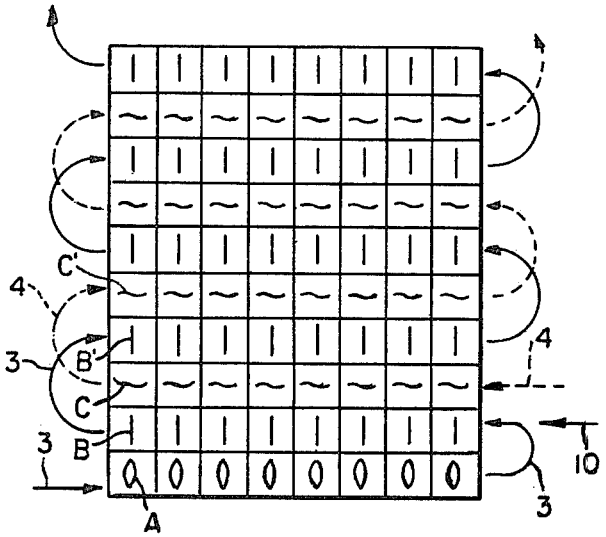
FIG. 2 is a diagram showing the conventional texture of a knitted fabric having the same pattern on both the front and back faces and comprises stitches of forward knitting and back knitting, which is formed by using the double-hooked needle of the present invention.

Referring now to FIG. 2, a row of chain stitches A (each chain stitch indicated by the mark 0) of a length corresponding to the length of the knitted fabric to be formed is formed with yarn 3 by using the hook on one end, for example, the leading hook 2 (for simplification of the illustration, formation of a fabric having a length equal to the length of the stem 1 is explained). From the end of the row of chain stitches, first forward knitting B (each Afghan stitch indicated by the mark 1) is conducted with the yarn 3 by the same leading hook 2 in the direction indicated by an arrow 10, namely in a direction opposite to the direction in which the chain stitches A were knitted. At this point, respective stitches are left on the stem 1. Then, while another yarn 4 is being supplied to the trailing hook 2′ on the other hand, first back knitting C (each complete stitch indicated by the mark ~) is conducted, whereby the stitches are gradually taken off the stem 1, and a knitted fabric is formed when the trailing hook 2′ arrives at the left end in FIG. 2. At this point, the fabric is reversed from one side to the other, and second forward knitting B′ is conducted in the same manner as the above first forward knitting B, and then, second back knitting C′ is conducted in the same manner as the first back knitting C. In this manner, forward knitting and back knitting are repeated, whereby knits and purls are formed to appear alternately and a knitted fabric having the same pattern on both the front and back faces is obtained.

Figure 3:
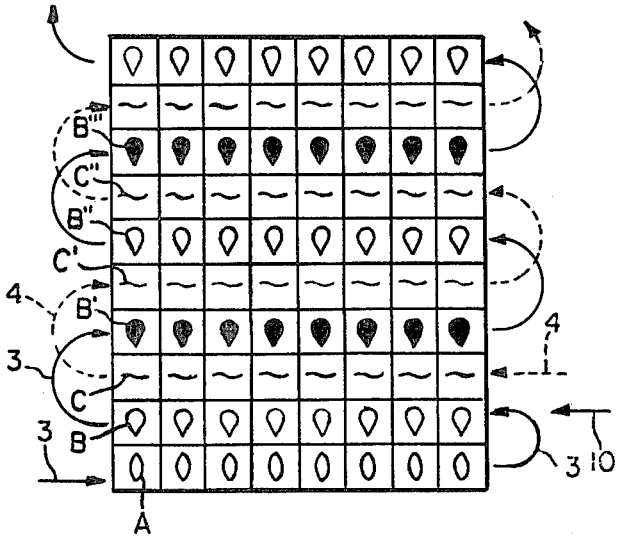
FIG. 3 is a diagram showing one embodiment of new textures of a knitted fabric according to the method of the present invention.
Figure 4A:
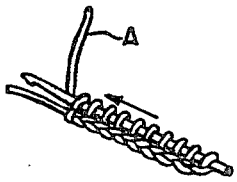
FIGS. 4*a* to 4*f* are perspective views showing the steps of knitting fabric as shown in the diagram of the FIG. 3.
Figure 4B:
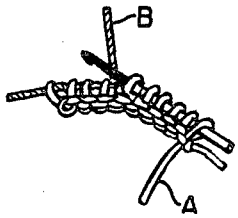
Figure 4C:
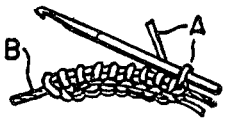
Figure 4D:
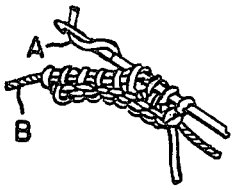
Figure 4E:
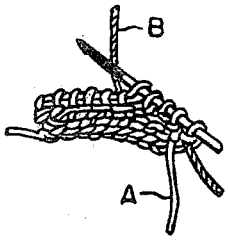
Figure 4F:
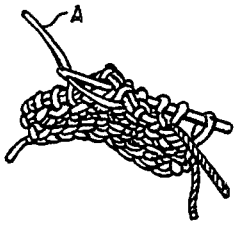

Referring to FIGS. 3 and 4 which show one embodiment of knitting method according to the invention, a row of chain stitches A (each mark O indicates a chain stitch) of a length corresponding to the length of the knitted fabric to be formed is formed with yarn 3 by using the hook on one end, for example, the leading hook 2. From the end of the row of chain stitches, first forward knitting B (each mark V indicates a stockinette Afghan stitch) is conducted with the yarn 3 by the same leading hook 2 in the direction indicated by an arrow 10. At this point respective stitches are left on the stem 1 as shown in the FIG. 4*a*. Then another yarn 4 is supplied to the trailing hook 2′ on the other hand and first back knitting C (each mark ~ indicates a complete stitch) is conducted as shown in the FIG. 4*b*, whereby the stitches are gradually taken off the stem 1. A knitted fabric is formed when the trailing hook 2′ arrives at the left end in FIG. 3. However, only the last stitch is knitted with yarn 3. At this point, the trailing hook 2′ is removed from that stitch, the leading hook 2 is inserted in the stitch instead in preparation for second forward knitting as shown in the FIG. 4*c*. Second forward knitting B′ (each mark  indicates a reversed stockinette Afghan stitch) is conducted with yarn 3 as shown in the FIG. 4*d*. Then, second back knitting C′ is conducted with yarn 4 in the same manner as the first back knitting as shown in the FIG. 4*e*. Then, third forward knitting B″ is conducted with yarn 3 forming stockinette Afghan stitches as shown in the FIG. 4*f*. In this manner, forward knitting and back knitting are repeated. That is, the cycle which consists of forward knitting of stockinette Afghan stitches, back knitting of complete stitches, forward knitting of reversed stockinette Afghan stitches and back knitting of complete stitches is repeated.

When the yarns are of different color, the fabric has faces of different color and pattern.

Figure 5:
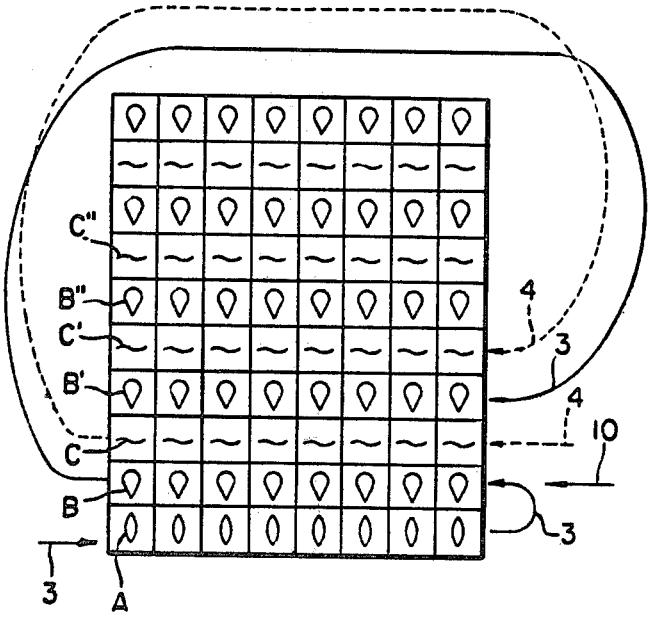
FIG. 5 is a diagram showing another embodiment of new textures of a knitted fabric according to the method of the present invention.
Figure 6A:
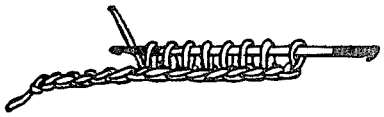
FIGS. 6*a* to 6*e* are perspective views showing the steps of knitting fabric as shown in the diagram of the FIG. 5.
Figure 6B:
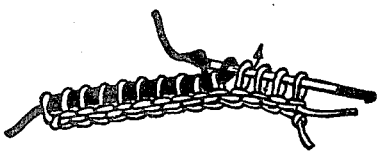
Figure 6C:
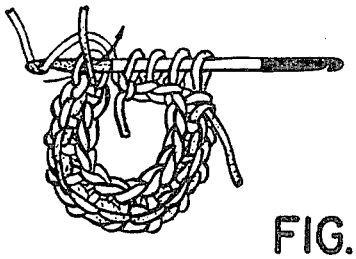
Figure 6D:
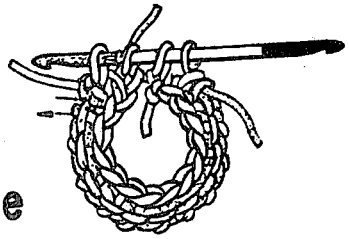
Figure 6E:
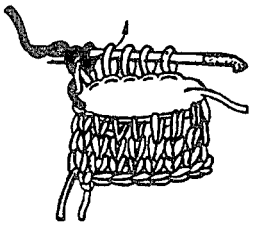

Referring now to FIGS. 5 and 6 which show another embodiment of knitting method according to the invention, a row of chain stitches A (each mark O indicates a chain stitch) of a length corresponding to the circular length of the ring-like or cylindrical knitted fabric to be formed is formed with yarn 3 by using the hook on one end, for example leading hook 2. From the end of the row of chain stitches, first forward knitting B (each mark indicates a stockinette Afghan stitch) is conducted with the yarn 3 by the same leading hook 2 in the direction indicated by an arrow 10, as shown in FIG. *6a*. At this point, respective stitches are left on the stem 1. Then while another yarn 4 is being supplied to the trailing hook 2' on the other hand, first back knitting C (each mark ~ indicates a complete stitch) is conducted as shown in the FIG. *6b*, whereby the stitches are gradually taken off the stem 1 and a knitted fabric is formed when the trailing hook 2' has almost arrived at the left side in the FIG. 2. When two or three stockinette Afghan stitches are left on the stem 1, the fabric is made into a ring by inserting the leading hook 2 into the stitch which has been made first at the first stage and withdrawing the leading hook 2 in such manner that the leading hook 2 engages with the yarn 3 as illustrated in the FIG. *6c*. Then, second forward knitting B' at the second stage is conducted forming stockinette Afghan stitch in the same manner as the first forward knitting B. Then second back knitting C' is conducted in the same manner as the first back knitting C. In this method of knitting fabric, the forward knitting is first conducted with one hook followed by back knitting with the other hook.

The fabric is preferably knitted of different color yarns.

Figure 7:
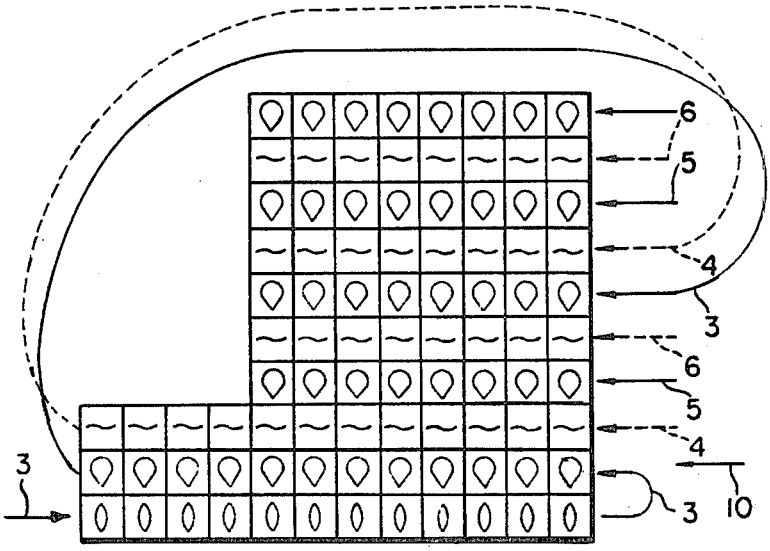
FIG. 7 is a diagram showing a further embodiment of new textures of a knitted fabric according to the method of the present invention.

Referring now to FIG. 7 which shows still another method of knitting according to the invention. The knitting method is the same as that of the second embodiment except that two needles are used and the first stage of knitting is conducted with a first needle and the second stage is conducted with a second needle in such a manner that the second needle follows up the first needle from which it is spaced by several stitches.

The fabric is made by the first needle in the same manner as in the second embodiment until the fabric is made into a ring at the first stage. Then, yarns 5 and 6 which are different from yarns 3 and 4 are applied to the fabric by the second needle and the forward knitting is conducted with yarn 5 and the back knitting is conducted with yarn 6 in such a manner that the yarn 6 follows up the yarn 5. Then, when the second stage above-mentioned is completed, the third stage is conducted with yarns 3 and 4. In the manner, other stages of knitting are repeated.

The fabric is preferably made by using yarns all of different colors.

Compared with the second embodiment, this embodiment has an advantage that no step structure appears in the stripe pattern of the fabric.

As is seen from the foregoing illustration, when the stick-like double-hooked needle of the present invention is employed, stitches formed by ordinary knitting by a hook on one end can easily pass over the other hook on the other end and knitting is performed by both hooks. Accordingly, the knitting operation can be greatly simplified. Furthermore, by using one stick-like double-hooked needle having a length of about 40 cm and hence, being very easy to handle, even a very long knitted article or a ring-like knitted article can be formed very easily and promptly. Moreover, the resulting fabric can be used on either the front face or the back face conveniently, and therefore, the method of knitting fabric by the stick-like double-hooked needle of the present invention is very suitable for knitting articles having turned back portions such as shawls and suits.

What is claimed is:

1. A method of knitting ring-like fabric by at least one stick-like double-hooked needle which comprises the steps of:

(a) preparing a row of chain stitches with one yarn by one hook of the needle;

(b) making forward knitting of stockinette Afghan stitches with said one yarn by said one hook of the needle, (c) making back knitting of complete stitches with another yarn by another hook of the needle, (d) making the fabric to be in the form of a ring, (e) repeating the steps of (b) and (c), and wherein first stage of said steps (b) and (c) is conducted with two yarns by one needle, second stage of steps (b) and (c) is conducted with another two yarns by another needle, and said two stages are alternately repeated.

* * * * *